US006501226B2

(12) United States Patent
Lai et al.

(10) Patent No.: US 6,501,226 B2
(45) Date of Patent: Dec. 31, 2002

(54) DRIVING SYSTEM AND METHOD FOR ELECTROLUMINESCENCE DISPLAY

(75) Inventors: Wai-Yan Stephen Lai, Kowloon (HK); Wah Chi Raymond Wang, Taipo, NT (HK); Hing Kau Stephen Cheung, Mid-Levels (HK); Wai Yu Felix Wong, Kowloon (HK); Chung Yee Ricky Ng, Ma On Shan (HK)

(73) Assignee: Solomon Systech Limited, Hong Kong (CH)

( * ) Notice: Subject to any disclaimer, the term of this patent is extended or adjusted under 35 U.S.C. 154(b) by 3 days.

(21) Appl. No.: 09/782,480

(22) Filed: Feb. 12, 2001

(65) Prior Publication Data

US 2002/0097002 A1 Jul. 25, 2002

(30) Foreign Application Priority Data

Jan. 19, 2001 (TW) ..... 90101322 A

(51) Int. Cl.[7] ..... G09G 3/30; G09G 3/00; G09G 3/10

(52) U.S. Cl. ..... 315/169.1; 315/169.3; 345/101

(58) Field of Search ..... 315/169.1, 169.3, 315/169.4, 334, 350; 345/101, 76, 60, 78

(56) References Cited

U.S. PATENT DOCUMENTS 5,594,463 A * 1/1997 Sakamoto ..... 345/76
5,920,154 A * 7/1999 Hush ..... 315/169.1
6,104,363 A * 8/2000 Kobayashi et al. ..... 345/76
6,191,535 B1 * 2/2001 Saitou ..... 315/169.3
6,262,540 B1 * 7/2001 Seko ..... 315/169.1
6,310,589 B1 * 10/2001 Nishigaki et al. ..... 345/76
6,366,026 B1 * 4/2002 Saito et al. ..... 315/169.1
6,376,994 B1 * 4/2002 Ochi et al. ..... 315/169.1

* cited by examiner

*Primary Examiner*—Don Wong
*Assistant Examiner*—Chuc Tran
(74) *Attorney, Agent, or Firm*—Baker & McKenzie, Taipei; Ya-Chiao Chang; Anna Y. Tsang

(57) ABSTRACT

A driving system and its corresponding driving scheme for electroluminescence displays that employs the principle of electric charge conservation and recycling in order to reduce switching current requirement against the system power source. In an electroluminescence display of a matrix of electroluminescence elements arrayed in rows and columns, wherein anodes of the electroluminescence elements on each row being electrically connected to a corresponding anode line, and cathodes of the electroluminescence elements on each column being electrically connected to a corresponding cathode line, a driving system for driving said electroluminescence display comprises a row/column control circuit for lighting at least one of said electroluminescence elements by establishing an electrical route across the power source and the ground in a driving scheme. The driving scheme sequentially scans each of the cathode lines while simultaneously drives at least one of the anode lines during each scanning. The control circuit equalizes electric charges in electroluminescence elements in the cathode line being scanned and in an adjoining cathode line to be scanned subsequently by electrically connecting both cathode lines together before the scanning cycles to the adjoining cathode line.

24 Claims, 11 Drawing Sheets

DRIVING SYSTEM AND METHOD FOR ELECTROLUMINESCENCE DISPLAY

BACKGROUND OF THE INVENTION

1. Field of the Invention

This invention relates generally to electroluminescence displays and more particularly to a driving system for electroluminescence displays and the method of operating the system with reduced power demand and increased performance in response speed.

2. Description of Related Art

A typical electroluminescence display is an apparatus based on a panel of electroluminescence elements organized in a two-dimensional matrix of rows and columns. In general, each of the electroluminescence elements of the display has two electrodes of the opposite electric polarity: an anode and a cathode. One of the electrodes is connected to a row line while the other to a column line of the driving circuitry of the system. Each of the electroluminescence elements in the matrix is located where the addressing row and column lines for that particular element intersect.

An electroluminescence element emits light when it conducts electric current. This is achievable when a voltage across the anode and cathode of the element is supplied in the forward polarity—a positive voltage to the anode and a negative to the cathode. Intensity of the light emitted is determined by the magnitude of the current, which, in turn, is dependent on the voltage applied across the electrodes.

In operation, a driving scheme is employed to display data on the panel of the two-dimensional matrix of an electroluminescence display. A typical driving scheme for driving such an electroluminescence display involves sequentially activating each and every of either rows or columns of the electroluminescence elements in the matrix, one at a time in a scanning manner. While each row or column is activated, selected elements in the activated row or column are then turned on via established electrical routes to the power source of the drive system so that they can be energized and emit light. The addressed elements are activated sequentially in the repeated scanning cycles at a speed sufficiently fast such that the sequentially emitting elements appear to the human eyes as being lighted simultaneously, allowing for a properly perceived image.

A common driving scheme in such electroluminescence displays is one that scans the rows in the matrix of display elements. Display element rows in the matrix are addressed one after another sequentially. Meanwhile, appropriate power or ground sources drive the element columns so as to activate or deactivate the electroluminescence elements respectively in accordance with the requirement of the image data to be displayed.

FIG. 11 is a schematic diagram illustrating the circuit configuration of a conventional driving system for an electroluminescence display panel. The prior-art panel exemplified here has a matrix of 64 rows by 132 columns of display elements. In the matrix, each element is designated as elements $E_{C,R}$, wherein the subscript "C" identifies the column and "R" the row positional designation. In the entire matrix consisting of $E_{1.1}$–$E_{132.64}$, anodes of each column of the electroluminescence display elements are electrically connected together and to their respective anode lines $A_1$–$A_{132}$. In a similar arrangement, cathodes of each row of the elements are connected to their respective cathode lines $B_1$–$B_{64}$.

As is seen in the drawing, one among the 64 display element rows, namely the top row with elements connected to the cathode line $B_1$ in the depicted prior-art example, is activated by connection to ground via its assigned cathode line scanning switch $\mathbf{5}_1$ of the cathode line scanning circuit 1. Meanwhile, all the other elements in cathode lines $B_2$–$B_{64}$ remain de-activated by connection to power $V_{cc}$ via their respective cathode line scanning switches $\mathbf{5}_2$–$\mathbf{5}_{64}$. Note that cathode line scanning circuit 1 is essentially an array of switches that are responsible for connecting the rows of display elements alternatively to power and ground voltages of the system.

Anode line driving circuit 2, essentially an array of switches for connecting the display element columns to the power source, activates selected ones of the display element columns by connecting them to their respectively-assigned ones of the current sources $\mathbf{2}_1$–$\mathbf{2}_{132}$. Such connection is achieved by switching control of the anode line driving switches $\mathbf{6}_1$–$\mathbf{6}_{132}$. Columns to be de-activated are instead connected to ground through anode line resetting switches $\mathbf{7}_1$–$\mathbf{7}_{132}$ in the anode line resetting circuit 3, which is essentially an array of switches used to selectively connect the columns to ground.

Note that switching operation of the cathode line scanning switches $\mathbf{5}_1$–$\mathbf{5}_{64}$ in the cathode line scanning circuit 1 is basically in a sequential and cyclic repeating manner. By contrast, switching operation of the anode line driving switches $\mathbf{6}_1$–$\mathbf{6}_{132}$ in the anode line driving circuit 2 and switches $\mathbf{7}_1$–$\mathbf{7}_{132}$ in the anode line resetting circuit 3 are in synchronism in accordance with the column data of the image to be displayed.

For example, in the prior art system of FIG. 11, elements $E_{1.1.}$ and $E_{2.1}$ are emitting light while other elements are turned off. In order for elements $E_{1.1}$ and $E_{2.1}$ to be turned on and emit light, switches $\mathbf{6}_1$ and $\mathbf{7}_1$ corresponding to the anode line $A_1$ have to be switched in synchronization while their row, the one at cathode line $B_1$, is scanned. The same applies to switches $\mathbf{6}_2$ and $\mathbf{7}_2$.

Off elements include those uncharged ones such as $E_{3.1}$ and charged ones such as $E_{3.2}$. In the drawings, turned-on display elements are represented by the symbol of a light-emitting diode, and turned-off elements are represented by the symbol of a capacitor, with charged elements expressed as symbols of capacitors with shading, and partially-charged and uncharged ones as regular capacitors. The charged and uncharged status of these turned-off display elements depends on the magnitude of the electric potential present across the electrodes of the elements.

In an electroluminescence display, parasitic capacitance inherent in the elements represents a major problem. Because of large capacitive loading on the lines as well as the effect of charge storage, quality of displayed image deteriorates when light emission time duration for any particular element becomes non-uniform in the repeated frame cycles as a result of different image patterns. The phenomenon that off elements are induced to emit slightly due to signal cross-coupling under large-capacitance load switching conditions also degrades the display quality.

At least one prior art, for example, Okuda et al. in U.S. Pat. No. 5,844,368 titled "Driving system for driving luminous elements" disclosed a system that attempted to minimize these problems by forcing the rows and columns to definite supply levels in order to achieve certain reference situation before activation of the elements. In another prior art, Lee in U.S. Pat. No. 4,975,691 titled "Scan inversion symmetric drive" disclosed a system that reversed the scan sequence of the rows for each frame. The reversed scanning in its alternating sequences of applications of the write voltage to the row electrodes was hoped to cause the average residual dc voltage across each of the display pixel elements to be substantially reduced, so that problems such as latent image caused by the inherent capacitive characteristics of electroluminescence displays may be avoided. However, in these prior attempts, the large panel capacitance are charged and discharged by supplying large switching currents from the power sources. These switching currents increase with panel size and with scan speed. Minimizing these switching currents and their subsequent noise issues have become important particularly for driving systems used in mobile electronic appliances.

It is therefore an object of the invention to provide a driving system and its corresponding driving scheme for electroluminescence displays that employs the principle of electric charge conservation and recycling in order to reduce switching current requirement against the system power source.

SUMMARY OF THE INVENTION

In an electroluminescence display of a matrix of electroluminescence elements arrayed in rows and columns, wherein anodes of the electroluminescence elements on each row being electrically connected to a corresponding anode line, and cathodes of the electroluminescence elements on each column being electrically connected to a corresponding cathode line, a driving system for driving said electroluminescence display comprises a row/column control circuit for lighting at least one of said electroluminescence elements by establishing an electrical route across the power source and the ground in a driving scheme. The driving scheme sequentially scans each of the cathode lines while simultaneously drives at least one of the anode lines during each scanning. The control circuit equalizes electric charges in electroluminescence elements in the cathode line being scanned and in an adjoining cathode line to be scanned subsequently by electrically connecting both cathode lines together before the scanning cycles to the adjoining cathode line.

BRIEF DESCRIPTION OF THE DRAWINGS

These and other features, aspects, and advantages of the invention will become better understood with regard to the following description, appended claims, and accompanying drawings where:

DETAILED DESCRIPTION OF THE PREFERRED EMBODIMENTS

Figure 1:
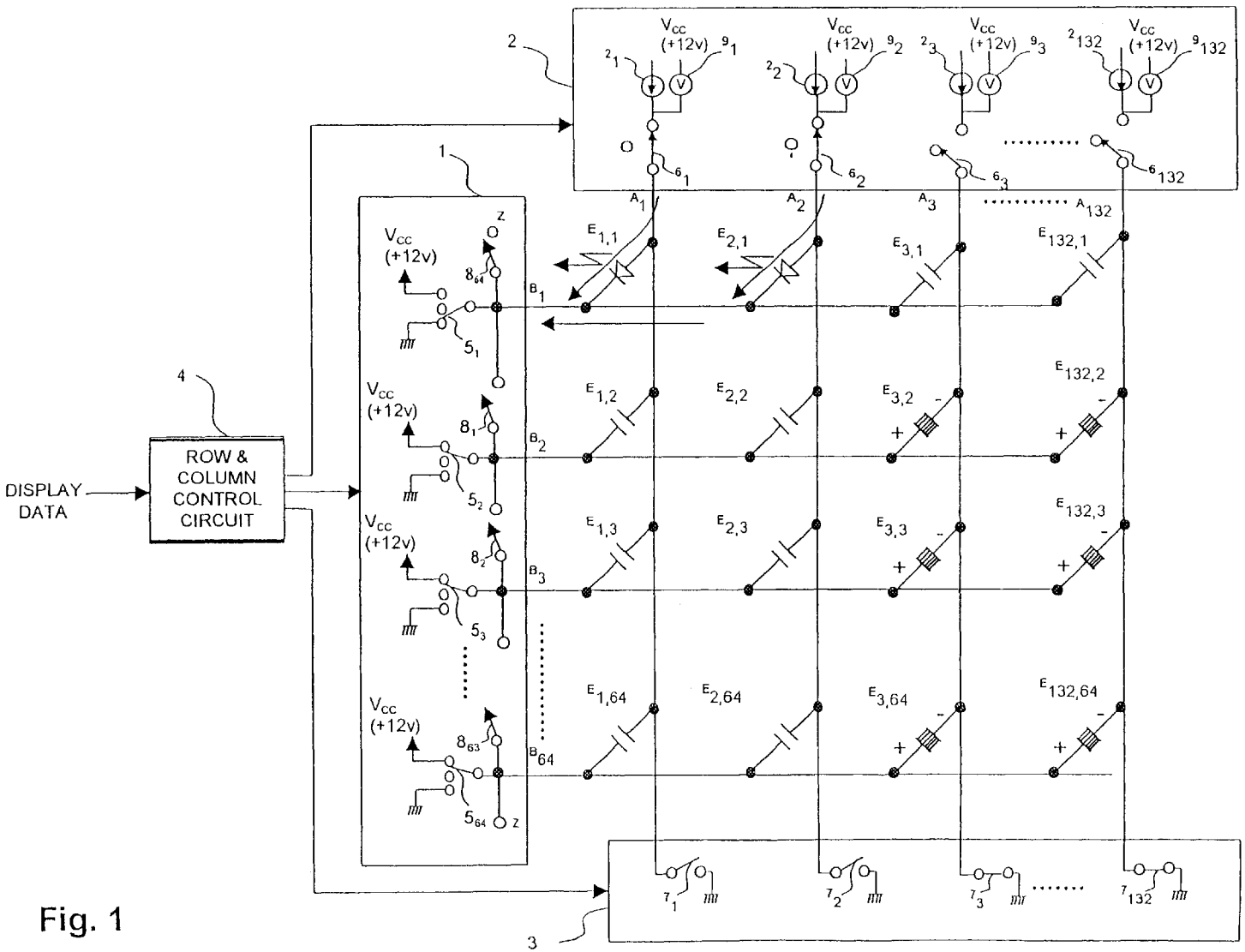
FIGS. 1–4 are respectively schematic diagrams of a first embodiment of the invention depicting each of the three different phases of operation in which no column equalization is applied.

For the description of the preferred embodiments of the driving system for the electroluminescence display as well as the method of implementing the driving of the display, a panel with a 64-row-by-132-column display element matrix is used as an example. In the matrix, elements are connected with anodes to the anode lines $A_1$–$A_{132}$ and cathodes to the cathode lines $B_1$–$B_{64}$. Such should not be considered as a limitation to the scope of the invention. It is only for the purpose of description that the driving system described herein assumes the connection configuration in which the electroluminescence elements have their cathodes connected to the row scan lines and anodes to the column drive lines. In general, by using equivalent variations based on the same principle, the driving system can be applied to other panel configurations where the element polarity as well as the scanning and driving roles of the rows and columns can be swapped.

Also as is comprehensible for those skilled in the art, switching operation of the switches $\mathbf{5}_1$–$\mathbf{5}_{64}$, $\mathbf{8}_1$–$\mathbf{8}_{64}$, $\mathbf{6}_1$–$\mathbf{6}_{132}$, and $\mathbf{7}_1$–$\mathbf{7}_{132}$ in their corresponding switch arrays are controlled by the row/column control circuit 4, as is schematically indicated in the drawings by arrow-headed lines leading from the control circuit 4 to the switch arrays 1, 2 and 3.

Note that in the accompanying drawings, the same reference numerals may be used to designate like components for the driving system of the invention. This includes reference numerals in the prior-art system of FIG. 11. For example, the cathode line scanning circuit 1 of the invention in all the described embodiments would incorporate the use of three-position cathode line scanning switches $\mathbf{5}_x$ that are different from two-position ones in the prior-art system. Also, an additional array of row equalization switches $\mathbf{8}_x$ are included in the scanning circuit 1 of the invention.

The present invention is directed toward a driving system and its corresponding driving scheme for electroluminescence displays that employs the principle of electric charge conservation and recycling in order to reduce switching current requirement against the system power source. Such an inventive driving system and its driving scheme also allow for the provision of electric charges sufficient to facilitate fast scanning of the rows and pre-charging of the columns.

Figure 11:
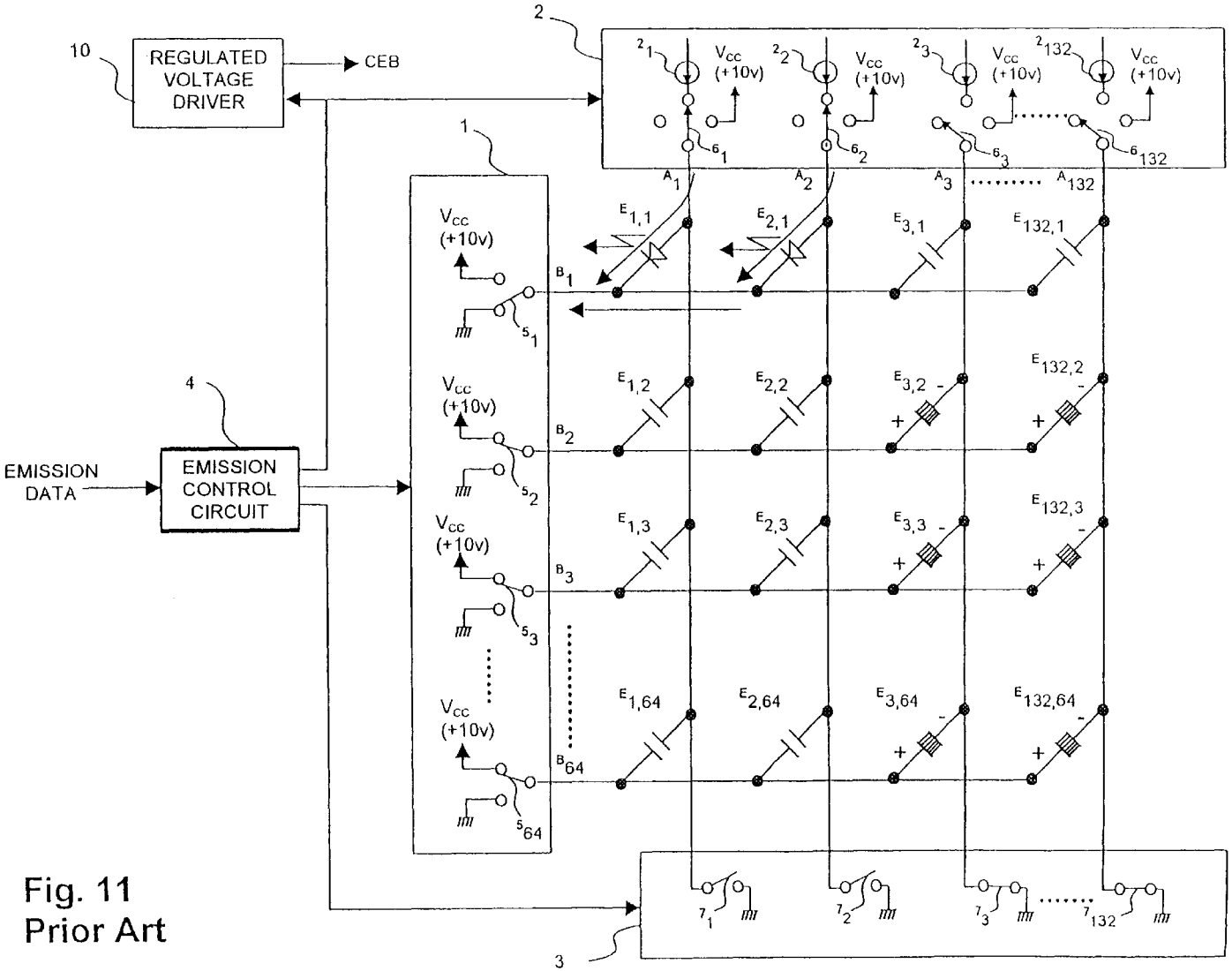
Fig. 11 Prior Art
FIG. 11 is a schematic diagram illustrating the circuit configuration of a conventional driving system for an electroluminescence display panel.

In the prior-art driving scheme, as can be recalled from the schematic of FIG. 11, when the scanned row is rotated from an activated to a subsequent one, the activated row is switched from ground to the de-activating system supply voltage $V_{cc}$. Meanwhile, the subsequent row that is rotated up to be subsequently scanned and activated is switched from its de-activated $V_{cc}$ to the activating ground voltage.

In this invention, by contrast, after the conclusion of the scanning of the first row and before the second row is switched into activated status, the two rows are electrically isolated from the rest of the system and, further, electrically connected together. Such isolation of the connected two rows from both the power $V_{cc}$ and the system ground allows all the display elements in them to equalize the electric charge amount as well as unify the positive or negative polarity in each and every one of them. In other words, these isolated and connected display elements may thus share the stored electric charges and reach to an intermediate electric potential in this voltage equalization phase. Sharing of electric charges is principally between the already-scanned row of elements and the subsequent to-be-scanned row of elements. Electric charges built up in the already-scanned row of elements are contributed to all the elements in the row to be scanned subsequently.

In this scheme, about half of the electric charges may be conserved and recycled, saving about half the electric charges that would otherwise have to be supplied by the system power source. This charge equalization in the row equalization phase may be implemented utilizing global row timing signals. Advantageously, this provides an efficient integration solution which requires a minimum number of components in the construction of a driving system for electroluminescence display.

In a row-scanning system, charge recycling and sharing techniques in the column-wise orientation are complicated by the unpredictability and randomness of column data. In the embodiments of the invention to be described later, two column equalization schemes can be employed to conserve and share electric charges among electroluminescence elements in the display. To implement such column equalization schemes, a global column equalization bus, a globally-controlled bus voltage driver and global column timing signals are required in order to minimize the complexity and number of components needed to construct the hardware.

Figure 2:
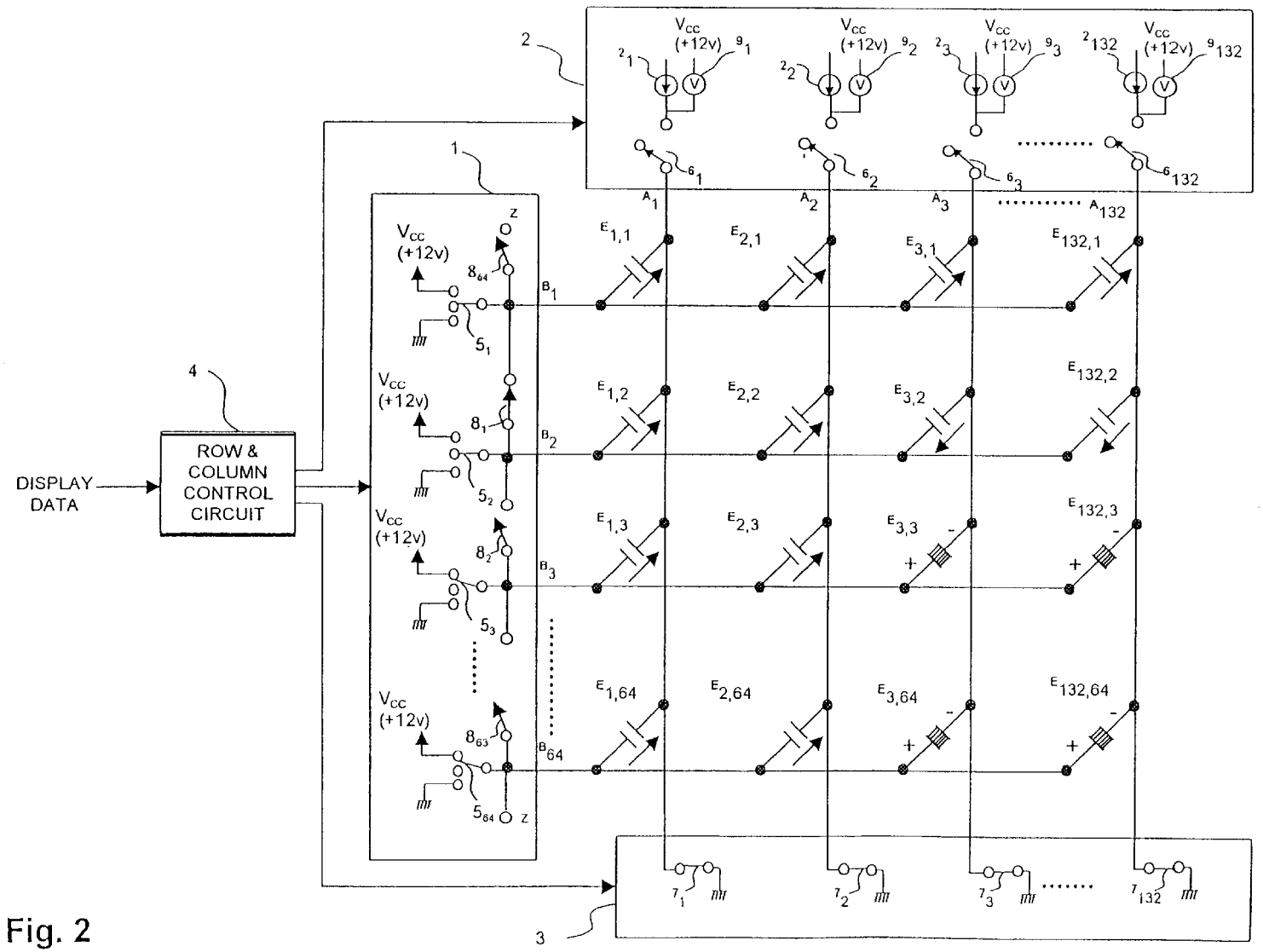

FIGS. 1–4 are respectively schematic diagrams of a first embodiment of the invention that employs no column equalization scheme. FIGS. 1 and 2 respectively depicts the first and second, and FIGS. 3 and 4 describe the third phase of the three different phases of operation of the first embodiment. These three phases include, from first to last, scanned-row lighting, row equalization, and scanned-row transition phases. These three subsequent operational phases constitute a complete cycle in which a method in accordance with the idea of the invention can be performed to control the driving scheme for the electroluminescence display.

In an electroluminescence display in accordance with a preferred embodiment of the invention, the panel of electroluminescence elements are organized in a two-dimensional matrix of rows and columns. Each of the electroluminescence elements has an anode and a cathode. One of the electrodes is connected to a row line while the other to a column line of the driving circuitry of the system. Each of the electroluminescence elements in the matrix is located where the addressing row and column lines for that particular element intersect.

A driving scheme in accordance with a preferred embodiment of the invention drives an electroluminescence display by sequentially activating each and every of either rows or columns of the electroluminescence elements in the matrix, one at a time in a scanning manner. While each row or column is activated by scanning, selected elements in the activated row or column are turned on via established electrical routes to the power source of the drive system so that they emit light.

In the first phase, selected ones of the display elements of the scanned row are controlled and energized to emit light in accordance with the requirement of the image to be displayed. As is illustrated in FIG. 1, in this scanned-row lighting phase, the top row on cathode line $B_1$ among all the matrix elements $E_{1.1.}$–$E_{132.1}$ is activated by the cathode line scanning switch $\mathbf{5}_1$ that connects the entire row to ground. In the mean time, all the other rows in the matrix are de-activated by connections of their respective cathode lines $B_2$–$B_{64}$ to power $V_{cc}$.

In order to light up elements $E_{1.1.}$ and $E_{2.1}$ in the top row as exemplified in the drawing, anode line driving circuit 2 charges columns on anode lines $A_1$ and $A_2$ by connecting them to the power source. In this described first embodiment of FIGS. 1–4, this power source is one combining a current source and a regulated voltage source. For example, the power source for the column on anode line $A_1$ has a current source $\mathbf{2}_1$ and a regulated voltage source $\mathbf{9}_1$ combined together, and that for line $A_2$ has a current source $\mathbf{2}_2$ and a voltage source $\mathbf{9}_2$, and so on.

Thus, in the scanned-row lighting phase as illustrated in FIG. 1, the columns to be charged on anode lines $A_1$ and $A_2$ are switched over to their corresponding power source respectively by anode line driving switch $\mathbf{6}_1$ and $\mathbf{6}_2$. Meanwhile, those columns to be charged need to have their corresponding anode line resetting switches in the anode line resetting circuit 3 disconnected from the system ground potential. In the described first embodiment of FIGS. 1–4, this requires the synchronized switching of switches $\mathbf{7}_1$ and $\mathbf{7}_2$ with respect to their corresponding switches $\mathbf{6}_1$ and $\mathbf{6}_2$ respectively, as is illustrated in FIG. 1.

In this manner, the close-circuit status of anode line driving switch $\mathbf{6}_1$, the open-circuit of anode line resetting switch $\mathbf{7}_1$, and the close-circuit of cathode line scanning switch $\mathbf{5}_1$, in combination, establishes a complete electrical route, which connects the display element $E_{1.1}$ across the power source and ground, thus lights up $E_{1.1}$. The same applies to element $E_{2.1}$ in the column of $A_2$. Note that during this scanned-row lighting phase, all row equalization switches $\mathbf{8}_1$–$\mathbf{8}_{64}$ remain turned off, i.e., open circuit, as is illustrated in FIG. 1.

Then, as the scanned-row lighting phase of FIG. 1 concludes and the row equalization phase commences as illustrated in FIG. 2, the two rows of display elements on cathode lines $B_1$ and $B_2$ need to be connected together and cut off electrically from the rest of the system. As mentioned above, this phase precedes another one in which the activation of display element rows is sequentially switched from the row on cathode line $B_1$ to that on $B_2$. FIG. 2 is a schematic diagram illustrating the circuit configuration of the first embodiment of the driving system of the invention in the row equalization phase, notably without the implementation of a column equalization scheme.

For this, cathode line scanning switches $\mathbf{5}_1$ and $\mathbf{5}_2$ disconnect their corresponding rows on lines $B_1$ and $B_2$ from the power source and ground. At the same time, row equalization switch $\mathbf{8}_1$ located between the lines $B_1$ and $B_2$ is switched close-circuit so as to connect the two rows on lines $B_1$ and $B_2$ together. Meanwhile, the anode lines $A_1$ and $A_2$ are connected to ground via anode line resetting switches $\mathbf{7}_1$ and $\mathbf{7}_2$ respectively. Ground path of anode lines $A_1$ and $A_2$ via switches $\mathbf{7}_1$ and $\mathbf{7}_2$ respectively allows the removal of residual voltages in the elements $E_{1.1}$ and $E_{2.1}$ that have just been lighted up in the previous phase. This is in order to enhance luminance uniformity of all the pixels in the matrix and to avoid the disadvantageous effect of cross-talk.

In this row equalization phase as shown in FIG. 2, since all elements in the two rows are connected together in circuit loops established by the close-circuit switch $\mathbf{8}_1$, electric charge sharing takes place among all the elements. Such is a phenomenon of charge recycling among the elements in the two rows.

It is important to note that such equalization of electric charges in this phase of operation allows for the electric charge accumulated in the elements of the activated row, on cathode line $B_1$ in the embodiment of FIGS. 1–4, to be transferred to the elements in the next-to-be-activated row, the one on line $B_2$. This electric charge transfer (or, sharing or equalization) not only reduces the charging requirement against the system power source when the subsequent row of elements are to be activated, it also speeds up response time when the second row is in turn activated and then charged due to the fact that they have already been partially charged. Also note that in this row equalization phase, all the display elements in these two rows settles to an intermediate equalization voltage.

Figure 3:
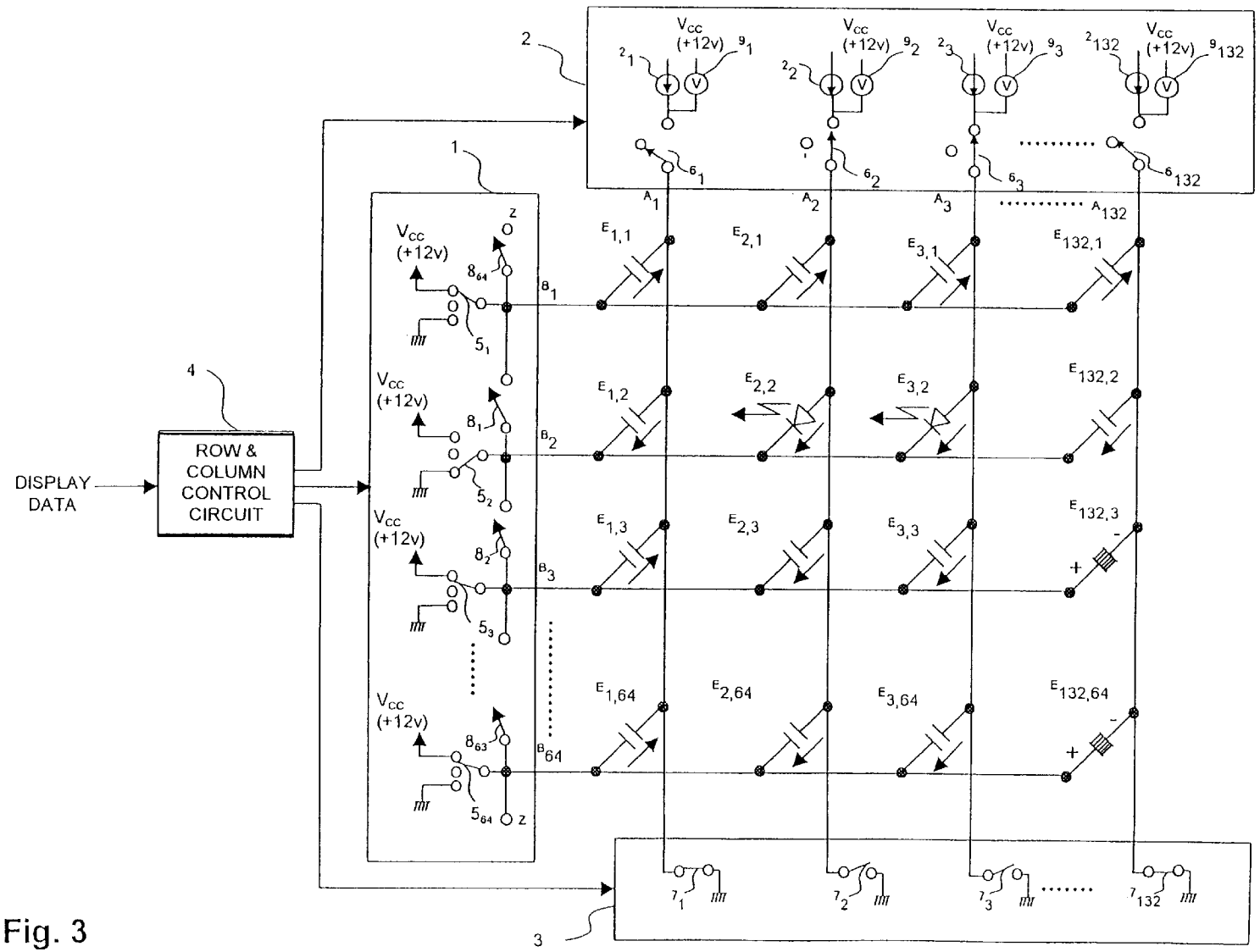

Then, with the conclusion of the row equalization phase, a third step of scanned-row transition phase follows. FIG. 3 is a schematic diagram illustrating the third step, scanned-row transition phase in a driving scheme for the driving system. In this third phase, row equalization switch $\mathbf{8}_1$ is switched open-circuit to disconnect cathode line $B_1$ from $B_2$. Cathode line scanning switch $\mathbf{5}_2$ then de-activates cathode line $B_1$ by connecting it to power source. Meanwhile, switch $\mathbf{5}_2$ activates line $B_2$ by connecting it to ground. On the other hand, selected columns of display elements are driven in accordance with new image data as is exemplified in FIG. 3. In this phase, the system power of combined voltage and current sources quickly brings the columns to be driven to the required activation voltage.

Figure 4:
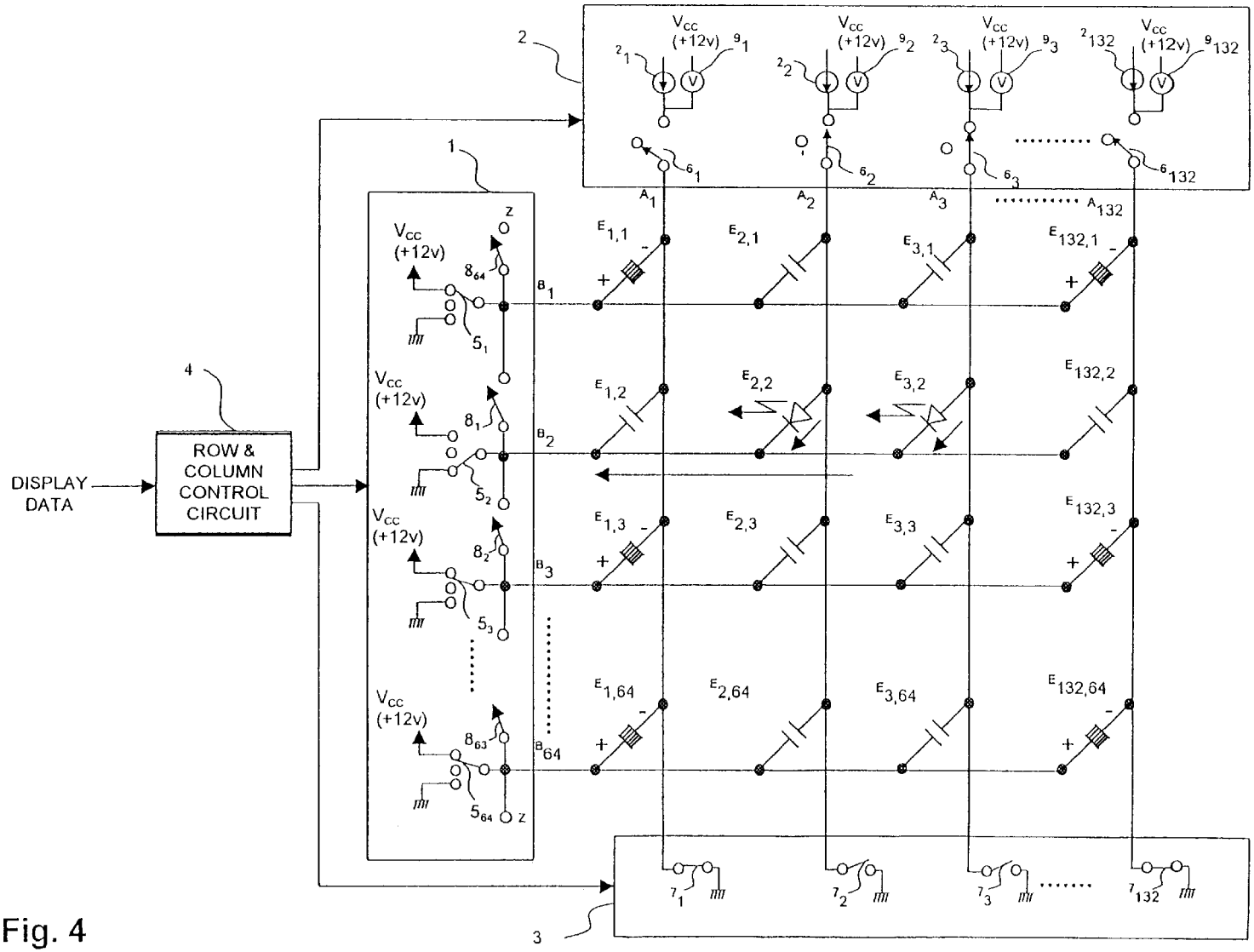

FIG. 4 illustrates the drive system in its third phase much like is illustrated in FIG. 3 except that display elements in those anode lines not being lighted in this scanned cycle becomes virtually fully-charged, as is schematically shown in the drawing by the capacitor symbols marked by the charged polarity signs "+" and "−." In this operational phase, the activation voltage brought up across the electrodes for those elements, such as $E_{2.2}$ and $E_{3.2}$ in the case of this described embodiment, allows these electroluminescence elements to emit light.

Operation of the various switches in the cathode line switching circuit 1, the anode line driving circuit 2 and the anode line resetting circuit 3 in the three sequential phases of operation as described with reference to FIGS. 1–4 for the first embodiment of the invention effectively concludes one scanning cycle for cathode lines $B_1$ and $B_2$ in the driving scheme. Scanning of the rows in the matrix then continues in a similar manner, from line $B_2$ to $B_3$ and so on, up to the last row $B_{64}$. The last row on cathode line $B_{64}$ then pairs with the first row on $B_1$ in a like manner as between rows on $B_1$ and $B_2$, and the scheme then recommences all over again, starting from the first row on cathode line $B_1$. In this process, repeated row equalization schemes are performed over every pair of two adjacent rows at the end of each scanned-row lighting phase in each sequenced row scanning.

The first embodiment as described above thus employs a scheme of row-wise charge equalization. Equalization along the column direction is not considered in this embodiment. Although electric charges in the column-wise display elements are not recovered without a column equalization scheme, circuit complexity for column control for the driving system can be relatively reduced. As a result, driving system for electroluminescence displays in accordance with the first embodiment of the invention as outlined in FIGS. 1–4 may enjoy lower costs because of reduced column circuit complexity. Although power consumption has not been optimized, they are suitable for applications not power or noise sensitive.

In contrast, driving scheme with column equalization in accordance with a second and a third embodiment of the invention to be described in detail in the following paragraphs may enjoy increased reduction in power consumption. Column control circuitry will become relatively more complex as a result of electric charge recovery along the column orientation. Such optimization in power consumption allows these driving systems to be particularly suitable for applications such as battery-powered mobile devices where power efficiency and reduction of switching current consumption are the utmost consideration.

FIGS. 5–8 are respectively schematic diagrams of a second embodiment of the invention depicting each of the three different phases of operation in which a first column equalization scheme is applied. These three phases include, from first to last, scanned-row lighting, row/column equalization, and scanned-row transition phases. Note that the second phase in this embodiment employs a row/column equalization as compared to a row-only equalization as in the embodiment of FIGS. 1–4 described above. Both row and column equalization are effectively completed in this same phase of operation. Also, as was indicated above, although a column equalization incurs relatively more complex column control circuitry, the power efficiency thus improved justifies for portable device applications.

Structurally, this driving system differs from the one illustrated in FIGS. 1–4 by the inclusion of a column equalization bus CEB, as well as the use of a globally-regulated voltage source 10 for energizing the CEB. Instead of an array of individually-regulated voltage source for the anode lines as was in the case of the first embodiment, the display system of FIGS. 5–8 has the voltage driver 10 driving anode lines $A_x$ via the CEB. In addition to the row equalization, a column equalization scheme will be added to the system driving scheme for this second embodiment. In other words, the method of driving the display system would be different.

In the first column equalization scheme employed by the embodiment of FIGS. 5–8, all the columns on anode lines previously or to be switched to high power supply potential are connected to the CEB, thus allowing display element in these columns to share electric charges already present. This achieves power conservation as a result of electric charge recycling. The CEB is maintained at an intermediate voltage, just low enough to turn off the previously-emitting elements during the row/column equalization phase, by the use of a globally-regulated voltage source. At the end of column equalization, those columns to be switched to ground voltage are disconnected from CEB, and before current driving toward individual column starts, the bus with the remaining columns are then brought up quickly to a potential sufficient to activate the elements by the global voltage driver.

Figure 5:
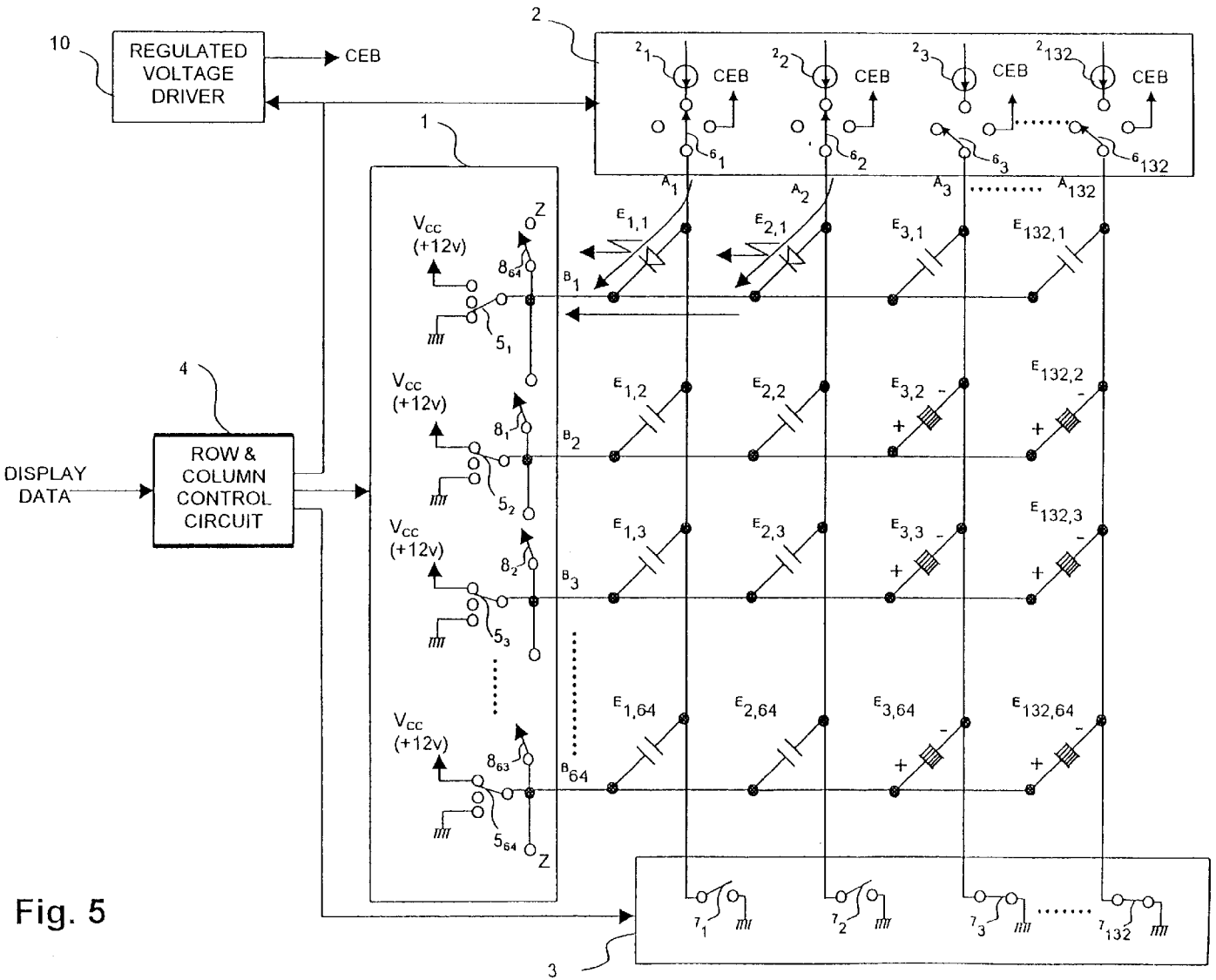
FIGS. 5–8 are respectively schematic diagrams of a second embodiment of the invention depicting each of the three different phases of operation in which a column equalization scheme is applied.

FIG. 5 is a schematic diagram illustrating the driving system of the electroluminescence display at its first step, the scanned-row lighting phase, of the driving scheme, with a first column equalization scheme. In this second embodiment with an additional column equalization, the operation of row equalization is substantially the same as that performed in the first embodiment described above.

Figure 6:
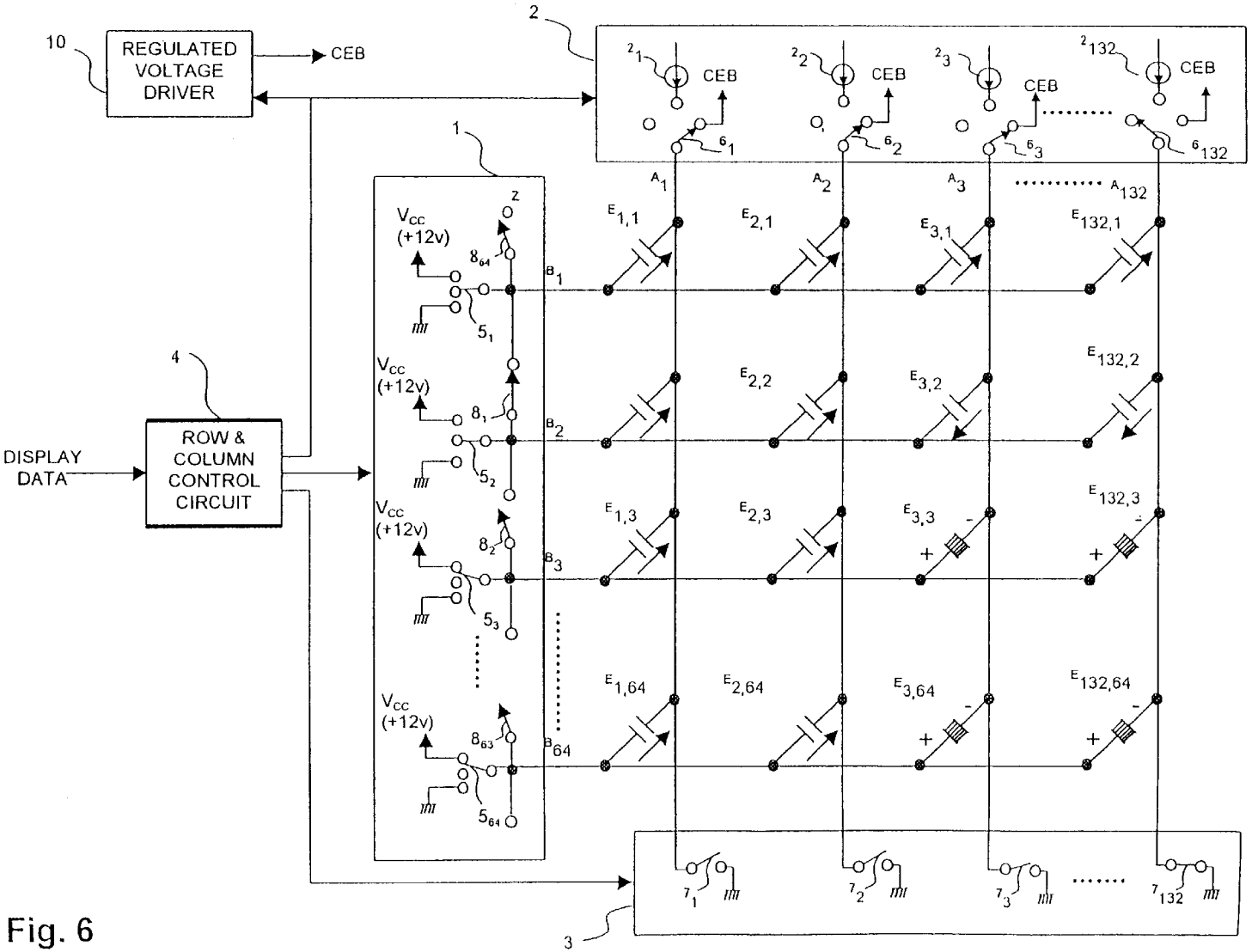

FIG. 6 illustrates the second step, the row/column equalization phase of the driving scheme. During the row/column equalization phase, anode line driving switches $\mathbf{6}_1$, $\mathbf{6}_2$ and $\mathbf{6}_3$ connect the previously-activated columns $A_1$ and $A_2$ and the next-to-be-activated column $A_3$ to CEB for charge sharing and voltage equalization. The globally-regulated voltage source 10 maintains the column equalization voltage at a level sufficiently low to effectively turn off the elements $E_{1.1}$ and $E_{2.1}$ that were previously emitting, as is shown in FIG. 6. In the process, switches $\mathbf{7}_1$, $\mathbf{7}_2$ and $\mathbf{7}_3$ maintain open-circuit in order to allow those columns on anode lines $A_1$, $A_2$ and $A_3$ to be connected to CEB to effect column equalization. In the column equalization scheme proposed, the residual voltages in the electroluminescence elements are equalized via connection onto the CEB, and the undesirable effects of display elements non-uniformity and cross-talk may thus be avoided.

Figure 7:
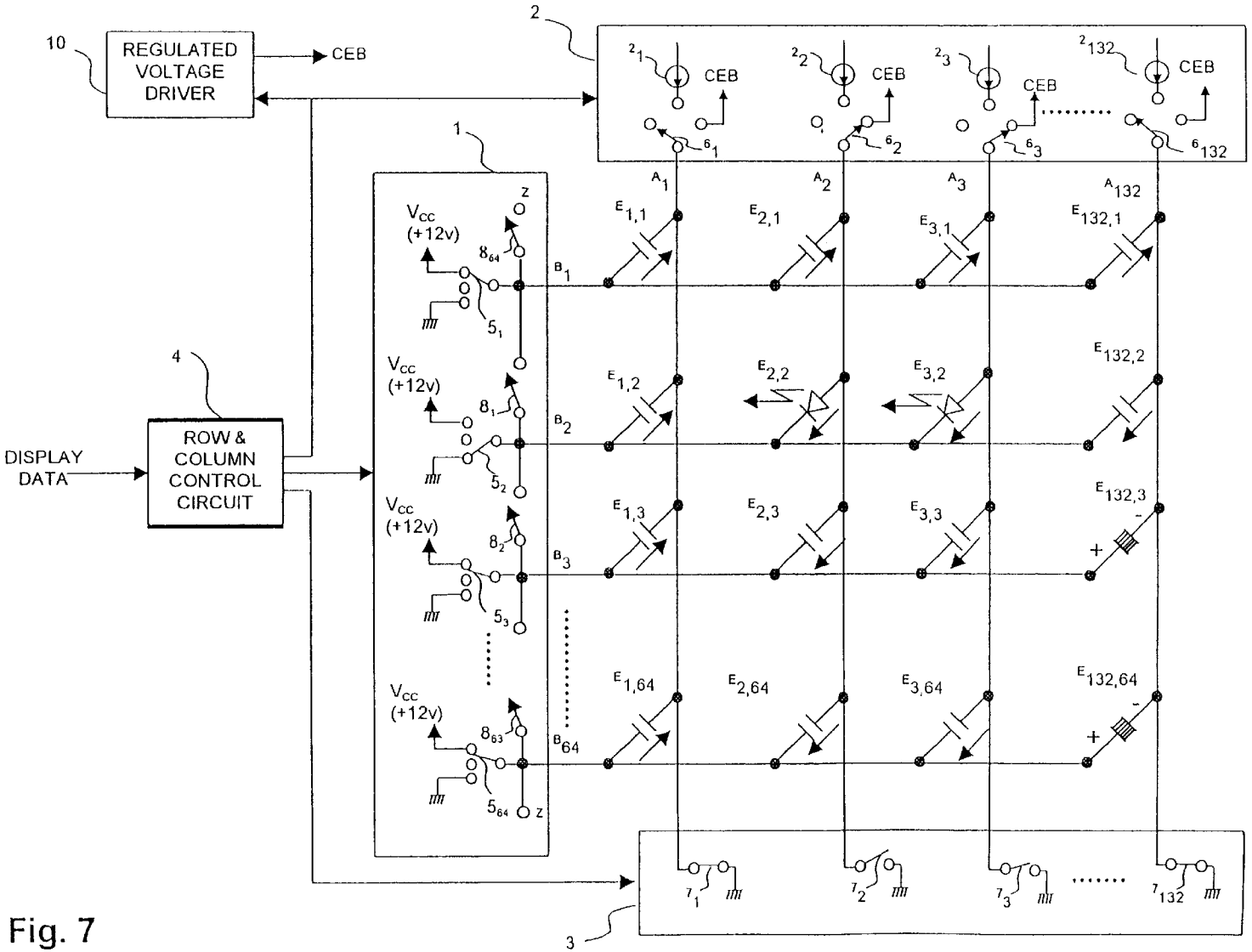

FIG. 7 illustrates the third step, the scanned-row transition phase, of the driving system with first column equalization scheme. As the row/column equalization phase concludes, anode line driving switch $6_1$ and others connect the elements in the column on anode line $A_1$ and those to be de-activated to ground voltage. Meanwhile, CEB brings the columns to be activated such as $A_2$ and $A_3$ to the required activation electric potential so that elements $E_{2.2}$ and $E_{3.2}$ may be energized and emit light when the row scan line $B_2$ is activated after row equalization, as is depicted in FIG. 7.

Figure 8:
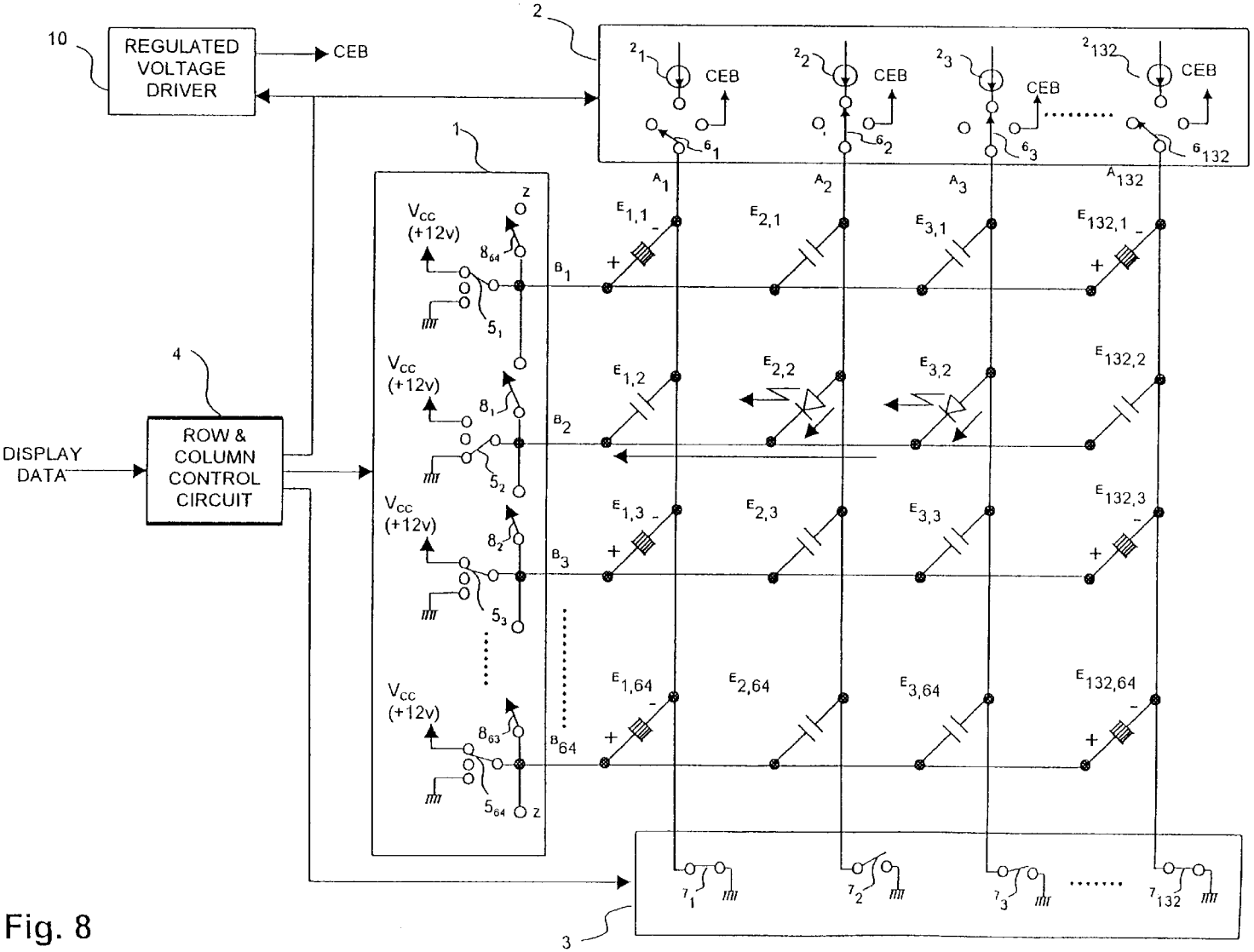

FIG. 8 illustrates another stage of the third phase of the driving system with first column equalization scheme. In this stage, current sources take over at the end with anode line driving switches $6_2$ and $6_3$ switched close-circuit so as to connect anode lines $A_2$ and $A_3$ to their respective current sources $2_2$ and $2_3$, as is shown in FIG. 8.

Figure 9:
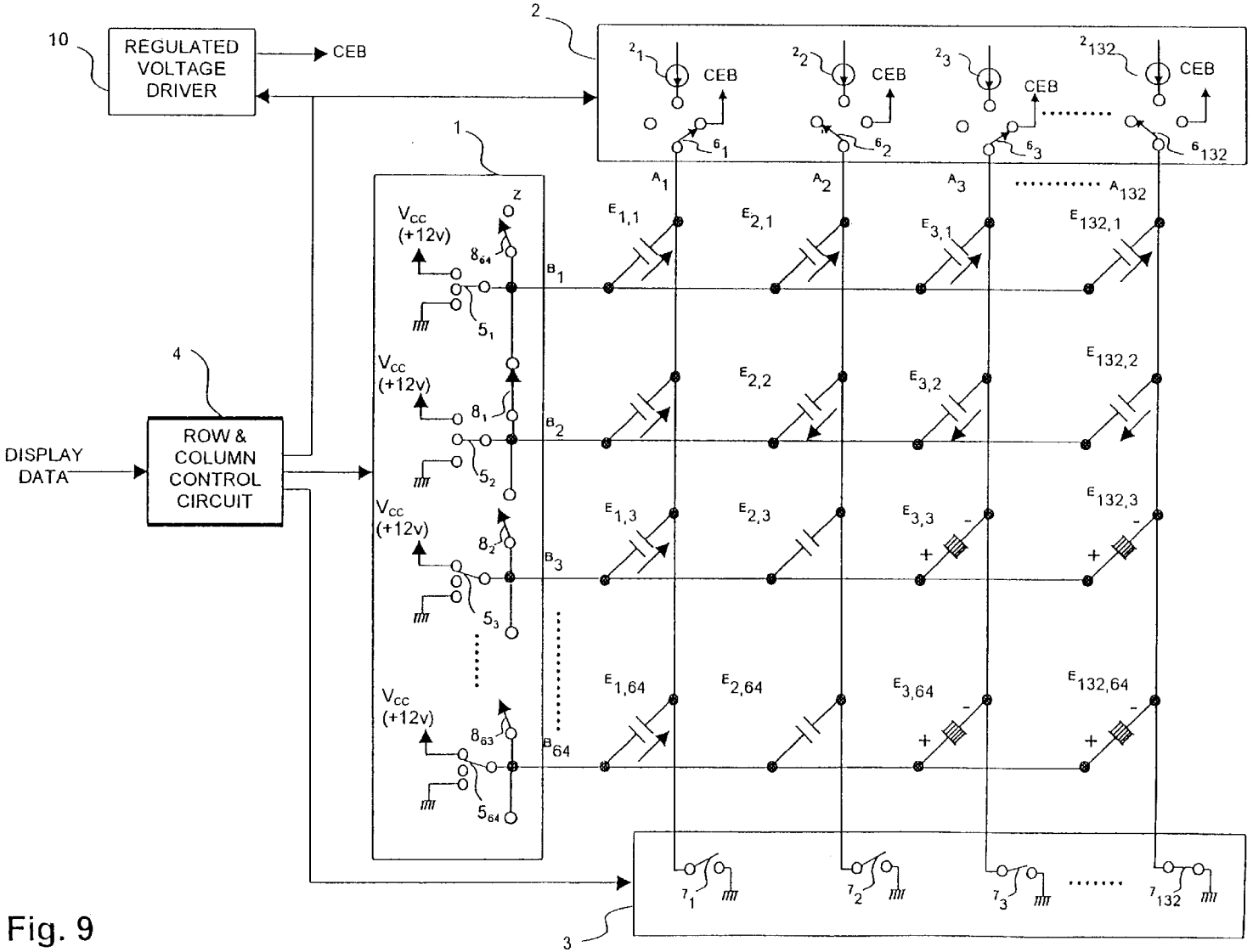
FIGS. 9 and 10 are respectively schematic diagrams of a third embodiment of the invention depicting two of the three different phases of operation in which a column equalization scheme is applied.
Figure 10:
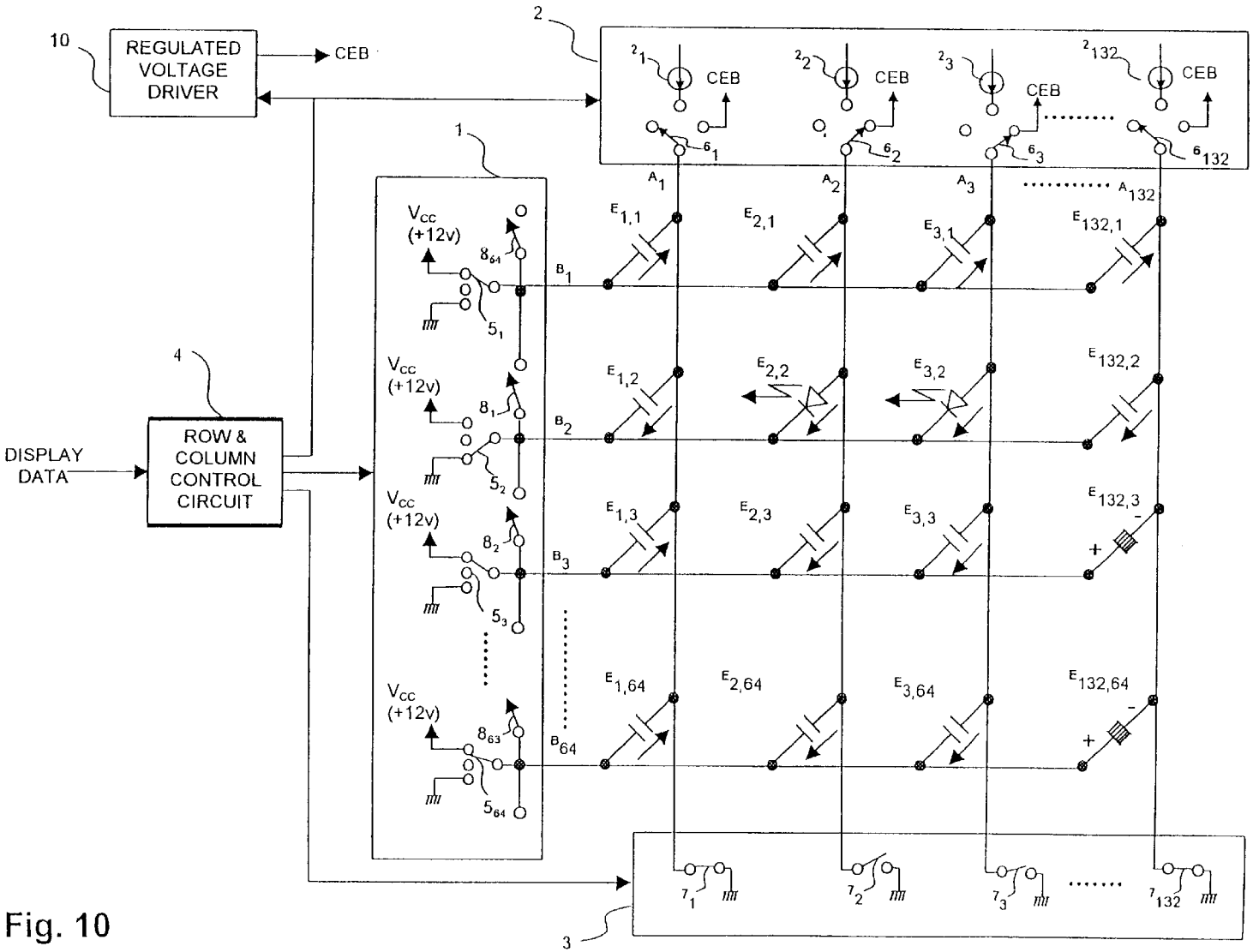

FIGS. 9 and 10 are respectively schematic diagrams of a third embodiment of the invention depicting two of the three different phases of operation in which a column equalization scheme is applied. In this second column equalization scheme employed by the embodiment of FIGS. 9 and 10, only those columns with altered image data are connected to the CEB. This is a scheme that allows these columns with display elements of opposite electric potential polarities to share electric charges and equalize potentials before they are separated and driven accordingly. Since some columns will remain at the previous high electric potential in this scheme, those previously-emitting elements are turned off solely relying on the action of row equalization, which reduces the voltage difference across the elements to a level below the perceptible light emission threshold. For electroluminescence elements with a sharp turn on voltage and exponential current-to-voltage characteristics, the reduction of voltage difference through row equalization is sufficient to effectively switch off the elements.

The embodiment of the driving system of the invention employing a second column equalization scheme as depicted in FIGS. 9 and 10 is in general similar to the first scheme (FIGS. 5–8) and differs only in the driving approach employed by its column equalization scheme. During the row/column equalization phase, anode line driving switches $6_1$ and $6_3$ connect elements in columns on anode lines $A_1$ and $A_3$, which are to be switched for opposite image data, to CEB for electric charge sharing and voltage equalization. FIG. 9 illustrates the second step, the row/column equalization phase, of the driving system for this embodiment.

At the end of the row/column equalization phase, anode line driving switches including $6_1$ then connect columns of elements on their corresponding anode lines to be de-activated to ground. Meanwhile, CEB brings columns to be activated such as $A_2$ and $A_3$ to the required activation potential for elements $E_{2.2}$ and $E_{3.2}$ to emit light when row scan line $B_2$ is activated after row equalization, as is depicted in FIG. 10. FIG. 10 illustrates the third step, the scanned-row transition phase, of the driving system with this second column equalization scheme. In this phase, current sources take over at the end with anode line driving switches $6_2$ and $6_3$ switched close-circuit so as to connect anode lines $A_2$ and $A_3$ to their respective current sources $2_2$ and $2_3$, similar as is shown in FIG. 8.

In these embodiments of the invention employing column equalization schemes, the globally-regulated voltage source 10 keeps CEB below a maximum column equalization voltage to effectively prevent the electroluminescence elements from emitting light. Without the voltage driver 10, the voltage appearing over CEB depends mainly on the ratio of the number of the previously-high columns to that of the low columns. To maximize charge conservation during the equalization phase, regulated voltage source 10 is not required to force CEB to a higher potential if CEB has already dropped below the maximum column equalization voltage.

While the above is a full description of the specific embodiments, various modifications, alternative constructions and equivalents may be used. For example, although general electroluminescence displays have been employed in the description of the embodiments of the invention, organic light emitting devices (OLED) and polymer electroluminescence devices (PELD) are in general equally applicable. Therefore, the above description and illustrations should not be taken as limiting the scope of the present invention which is defined by the appended claims.

What is claimed is:

1. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a row/column control circuit for lighting at least one of said electroluminescence elements by establishing an electrical route across the power source and the ground in a driving scheme that sequentially scanning each of said cathode lines while simultaneously driving at least one of said anode lines during each scanning, wherein said control circuit equalizing electric charges in electroluminescence elements in said cathode line being scanned and in an adjoining cathode line to be scanned subsequently by electrically connecting said scanned cathode line to said adjoining cathode line before cycling said scanning to said adjoining cathode line.

2. The driving system for electroluminescence display of claim 1, further comprising a cathode line scanning circuit switchably connecting a selected one of said cathode lines either to a power source, to ground, or floating and connecting a selected one of said cathode lines to an adjoining one of said cathode lines.

3. The driving system for electroluminescence display of claim 2, further comprising an anode line driving circuit switchably connecting selected ones of said anode lines to a power source.

4. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a cathode line scanning circuit switchably connecting a selected one of said cathode lines either to a power source, to ground, or floating and connecting a selected one of said cathode lines to an adjoining one of said cathode lines;

an anode line driving circuit switchably connecting selected ones of said anode lines to a power source; and a row/column control circuit for lighting at least one of said electroluminescence elements by establishing an electrical route across the power source and the ground in a driving scheme that sequentially scanning each of said cathode lines by connecting said scanned cathode line to ground via said cathode line scanning circuit while simultaneously driving at least one of said anode lines during each scanning by connecting said driven anode lines to power source via said anode line driving circuit, wherein said control circuit equalizing electric charges in electroluminescence elements in said cathode line being scanned and in an adjoining cathode line to be scanned subsequently by electrically connecting said scanned cathode line to said adjoining cathode line via said cathode line scanning circuit before cycling said scanning to said adjoining cathode line.

5. The driving system for electroluminescence display of claim 4, wherein said cathode line scanning circuit further comprising a plurality of cathode line scanning switches each switchably connecting a corresponding one of said cathode lines either to a power source, to ground, or floating and a plurality of row equalization switches each switchably connecting a corresponding one of said cathode lines to an adjoining one of said cathode lines.

6. The driving system for electroluminescence display of claim 4, wherein said anode line driving circuit further comprising a plurality of anode line driving switches each switchably connecting a corresponding one of said anode lines to a power source.

7. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a cathode line scanning circuit comprising a plurality of cathode line scanning switches each switchably connecting a corresponding one of said cathode lines either to a power source, to ground, or floating and a plurality of row equalization switches each switchably connecting a corresponding one of said cathode lines to an adjoining one of said cathode lines;

an anode line driving circuit comprising a plurality of anode line driving switches each switchably connecting a corresponding one of said anode lines to a power source; and a row/column control circuit for lighting at least one of said electroluminescence elements by establishing an electrical route across the power source and the ground in a driving scheme that sequentially scanning each of said cathode lines by connecting said scanned cathode line to ground via the corresponding one of said cathode line scanning switches while simultaneously driving at least one of said anode lines during each scanning by connecting said driven anode lines to power source via the corresponding ones of said anode line driving switches, wherein said control circuit equalizing electric charges in electroluminescence elements in said cathode line being scanned and in an adjoining cathode line to be scanned subsequently by electrically connecting said scanned cathode line to said adjoining cathode line via the corresponding one of said row equalization switches before cycling said scanning to said adjoining cathode line.

8. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a row/column control circuit for lighting at least one of said electroluminescence elements by establishing an electrical route across the power source and the ground in a driving scheme that sequentially scanning each of said cathode lines while simultaneously driving at least one of said anode lines during each scanning, wherein said control circuit equalizing electric charges in electroluminescence elements in said cathode line being scanned and in an adjoining cathode line to be scanned subsequently by electrically connecting said scanned cathode line to said adjoining cathode line, and equalizing electric charges in electroluminescence elements in said anode lines being driven and in electroluminescence elements in anode lines to be driven when said adjoining cathode line is subsequently scanned before cycling said scanning to said adjoining cathode line.

9. The driving system for electroluminescence display of claim 8, further comprising a cathode line scanning circuit switchably connecting a selected one of said cathode lines either to a power source, to ground, or floating and connecting a selected one of said cathode lines to an adjoining one of said cathode lines.

10. The driving system for electroluminescence display of claim 8, further comprising an anode line driving circuit switchably connecting selected ones of said anode lines to a power source or to a regulated voltage source via a column equalization bus.

11. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a cathode line scanning circuit switchably connecting a selected one of said cathode lines either to a power source, to ground, or floating and connecting a selected one of said cathode lines to an adjoining one of said cathode lines;

an anode line driving circuit switchably connecting selected ones of said anode lines to a power source or to a regulated voltage source via a column equalization bus; and a row/column control circuit for lighting at least one of said electroluminescence elements by establishing an electrical route across the power source and the ground in a driving scheme that sequentially scanning each of said cathode lines by connecting said scanned cathode line to ground via said cathode line scanning circuit while simultaneously driving at least one of said anode lines during each scanning by connecting said driven anode lines to power source via said anode line driving circuit, wherein said control circuit equalizing electric charges in electroluminescence elements in said cathode line being scanned and in an adjoining cathode line to be scanned subsequently by electrically connecting said scanned cathode line to said adjoining cathode line via said cathode line scanning circuit before cycling said scanning to said adjoining cathode line, and equalizing electric charges in electroluminescence elements in said anode lines being driven and in electroluminescence elements in anode lines to be driven when said adjoining cathode line is subsequently scanned by connecting said driven and to-be driven anode lines to a regulated voltage source via said column equalization bus before cycling said scanning to said adjoining cathode line.

12. The driving system for electroluminescence display of claim 11, wherein said cathode line scanning circuit further comprising a plurality of cathode line scanning switches each switchably connecting a corresponding one of said cathode lines either to a power source, to ground, or floating and a plurality of row equalization switches each switchably connecting a corresponding one of said cathode lines to an adjoining one of said cathode lines.

13. The driving system for electroluminescence display of claim 11, wherein said anode line driving circuit further comprising a plurality of anode line driving switches each switchably connecting a corresponding one of said anode lines to a power source or to a regulated voltage source via a column equalization bus.

14. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a cathode line scanning circuit comprising a plurality of cathode line scanning switches each switchably connecting a corresponding one of said cathode lines either to a power source, to ground, or floating and a plurality of row equalization switches each switchably connecting a corresponding one of said cathode lines to an adjoining one of said cathode lines;

an anode line driving circuit comprising a plurality of anode line driving switches each switchably connecting a corresponding one of said anode lines to a power source or to a regulated voltage source via a column equalization bus; and a row/column control circuit for lighting at least one of said electroluminescence elements by establishing an electrical route across the power source and the ground in a driving scheme that sequentially scanning each of said cathode lines by connecting said scanned cathode line to ground via the corresponding one of said cathode line scanning switches while simultaneously driving at least one of said anode lines during each scanning by connecting said driven anode lines to power source via the corresponding ones of said anode line driving switches, wherein said control circuit equalizing electric charges in electroluminescence elements in said cathode line being scanned and in an adjoining cathode line to be scanned subsequently by electrically connecting said scanned cathode line to said adjoining cathode line via the corresponding one of said row equalization switches, and equalizing electric charges in electroluminescence elements in said anode lines being driven and in electroluminescence elements in anode lines to be driven when said adjoining cathode line is subsequently scanned by connecting said driven and to-be driven anode lines to a regulated voltage source via said column equalization bus before cycling said scanning to said adjoining cathode line.

15. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a row/column control circuit for lighting at least one of said electroluminescence elements by establishing an electrical route across the power source and the ground in a driving scheme that sequentially scanning each of said cathode lines while simultaneously driving at least one of said anode lines during each scanning, wherein said control circuit equalizing electric charges in electroluminescence elements in said cathode line being scanned and in an adjoining cathode line to be scanned subsequently by electrically connecting said scanned cathode line to said adjoining cathode line, and equalizing electric charges in electroluminescence elements in said anode lines having image data to be altered in a subsequent scan when said adjoining cathode line is subsequently scanned before cycling said scanning to said adjoining cathode line.

16. The driving system for electroluminescence display of claim 15, further comprising a cathode line scanning circuit switchably connecting a selected one of said cathode lines either to a power source, to ground, or floating and connecting a selected one of said cathode lines to an adjoining one of said cathode lines.

17. The driving system for electroluminescence display of claim 15, further comprising an anode line driving circuit switchably connecting selected ones of said anode lines to a power source or to a regulated voltage source via a column equalization bus.

18. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a cathode line scanning circuit switchably connecting a selected one of said cathode lines either to a power source, to ground, or floating and connecting a selected one of said cathode lines to an adjoining one of said cathode lines;

an anode line driving circuit switchably connecting selected ones of said anode lines to a power source or to a regulated voltage source via a column equalization bus; and a row/column control circuit for lighting at least one of said electroluminescence elements by establishing an electrical route across the power source and the ground in a driving scheme that sequentially scanning each of said cathode lines by connecting said scanned cathode line to ground via said cathode line scanning circuit while simultaneously driving at least one of said anode lines during each scanning by connecting said driven anode lines to power source via said anode line driving circuit, wherein said control circuit equalizing electric charges in electroluminescence elements in said cathode line being scanned and in an adjoining cathode line to be scanned subsequently by electrically connecting said scanned cathode line to said adjoining cathode line via said cathode line scanning circuit before cycling said scanning to said adjoining cathode line, and equalizing electric charges in electroluminescence elements in said anode lines having image data to be altered in a subsequent scan when said adjoining cathode line is subsequently scanned by connecting said anode lines to a regulated voltage source via said column equalization bus before cycling said scanning to said adjoining cathode line.

19. The driving system for electroluminescence display of claim 18, wherein said cathode line scanning circuit further comprising a plurality of cathode line scanning switches each switchably connecting a corresponding one of said cathode lines either to a power source, to ground, or floating and a plurality of row equalization switches each switchably connecting a corresponding one of said cathode lines to an adjoining one of said cathode lines.

20. The driving system for electroluminescence display of claim 18, wherein said anode line driving circuit further comprising a plurality of anode line driving switches each switchably connecting a corresponding one of said anode lines to a power source or to a regulated voltage source via a column equalization bus.

21. In an electroluminescence display comprising a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, a driving system for driving said electroluminescence display comprising:

a cathode line scanning circuit comprising a plurality of cathode line scanning switches each switchably connecting a corresponding one of said cathode lines either to a power source, to ground, or floating and a plurality of row equalization switches each switchably connecting a corresponding one of said cathode lines to an adjoining one of said cathode lines;

an anode line driving circuit comprising a plurality of anode line driving switches each switchably connecting a corresponding one of said anode lines to a power source or to a regulated voltage source via a column equalization bus; and a row/column control circuit for lighting at least one of said electroluminescence elements by establishing an electrical route across the power source and the ground in a driving scheme that sequentially scanning each of said cathode lines by connecting said scanned cathode line to ground via the corresponding one of said cathode line scanning switches while simultaneously driving at least one of said anode lines during each scanning by connecting said driven anode lines to power source via the corresponding ones of said anode line driving switches, wherein said control circuit equalizing electric charges in electroluminescence elements in said cathode line being scanned and in an adjoining cathode line to be scanned subsequently by electrically connecting said scanned cathode line to said adjoining cathode line via the corresponding one of said row equalization switches before cycling said scanning to said adjoining cathode line, and equalizing electric charges in electroluminescence elements in said anode lines having image data to be altered in a subsequent scan when said adjoining cathode line is subsequently scanned by connecting said anode lines to a regulated voltage source via said column equalization bus before cycling said scanning to said adjoining cathode line.

22. In the driving system for an electroluminescence display of a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, said driving system comprising a row/column control circuit for lighting at least one of said electroluminescence elements by establishing an electrical route across the power source and the ground, a method of driving said electroluminescence display by said driving system comprising the steps of:

sequentially scanning each of said cathode lines while simultaneously driving at least one of said anode lines during each scanning; and said control circuit equalizing electric charges in electroluminescence elements in said cathode line being scanned and in an adjoining cathode line to be scanned subsequently by electrically connecting said scanned cathode line to said adjoining cathode line before cycling said scanning to said adjoining cathode line.

23. In the driving system for an electroluminescence display of a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, said driving system comprising a row/column control circuit for lighting at least one of said electroluminescence elements by establishing an electrical route across the power source and the ground, a method of driving said electroluminescence display by said driving system comprising the steps of:

sequentially scanning each of said cathode lines while simultaneously driving at least one of said anode lines during each scanning; and said control circuit equalizing electric charges in electroluminescence elements in said cathode line being scanned and in an adjoining cathode line to be scanned subsequently by electrically connecting said scanned cathode line to said adjoining cathode line, and equalizing electric charges in electroluminescence elements in said anode lines being driven and in electroluminescence elements in anode lines to be driven when said adjoining cathode line is subsequently scanned by connecting said driven and to-be driven anode lines to a regulated voltage source before cycling said scanning to said adjoining cathode line.

24. In the driving system for an electroluminescence display of a matrix of electroluminescence elements arrayed in a plurality of rows and columns, wherein cathodes of said electroluminescence elements on each of said rows being electrically connected to a corresponding cathode line, and anodes of said electroluminescence elements on each of said columns being electrically connected to a corresponding anode line, said driving system comprising a row/column control circuit for lighting at least one of said electroluminescence elements by establishing an electrical route across the power source and the ground, a method of driving said electroluminescence display by said driving system comprising the steps of:

sequentially scanning each of said cathode lines while simultaneously driving at least one of said anode lines during each scanning; and said control circuit equalizing electric charges in electroluminescence elements in said cathode line being scanned and in an adjoining cathode line to be scanned subsequently by electrically connecting said scanned cathode line to said adjoining cathode line, and equalizing electric charges in electroluminescence elements in said anode lines having image data to be altered in a subsequent scan when said adjoining cathode line is subsequently scanned by connecting said anode lines to a regulated voltage source before cycling said scanning to said adjoining cathode line.

* * * * *